United States Patent [19]

Ohshimatani et al.

[11] 4,376,528

[45] Mar. 15, 1983

[54] STEEL PIPE HARDENING APPARATUS

[75] Inventors: Toshio Ohshimatani, Aichi; Yukihiro Mimura, Handa; Kengo Nozawa; Tatsuo Maguchi, both of Aichi; Keiichiro Takitani, Nagoya, all of Japan

[73] Assignee: Kawasaki Steel Corporation, Kohbe, Japan

[21] Appl. No.: 299,202

[22] Filed: Sep. 3, 1981

[30] Foreign Application Priority Data

Nov. 14, 1980 [JP] Japan ..... 55-160285
Dec. 29, 1980 [JP] Japan ..... 55-187995
Feb. 2, 1981 [JP] Japan ..... 56-14093[U]

[51] Int. Cl.[3] ..... C21D 9/08

[52] U.S. Cl. ..... 266/114; 148/153; 148/155; 266/259; 266/85; 266/90; 432/85

[58] Field of Search ..... 266/114, 117, 259, 111-113; 148/143, 153, 155, 157, 131, 16; 432/77, 85; 134/105

[56] References Cited

U.S. PATENT DOCUMENTS 3,623,716 11/1971 Fritsch et al. ..... 134/137
3,997,375 12/1976 Franceschina et al. ..... 148/143

*Primary Examiner*—L. Dewayne Rutledge
*Assistant Examiner*—Christopher W. Brody
*Attorney, Agent, or Firm*—Wenderoth, Lind & Ponack

[57] ABSTRACT

An apparatus for hardening a steel pipe by quenching it with cooling water, comprises a cylindrical assembly including a casing and a cover, said casing being removably mated with said cover so that said cylindrical assembly may be selectively opened or closed, a plurality of supports disposed within said cylindrical assembly for supporting a steel pipe to be hardened so as to align the steel pipe with said cylindrical assembly, and nozzle means disposed at one end of said cylindrical assembly for injecting cooling water into said cylindrical assembly for cooling water to flow both outside and inside the steel pipe in the longitudinal direction thereof. The steel pipe is uniformly quenched over its entire length.

22 Claims, 22 Drawing Figures

STEEL PIPE HARDENING APPARATUS

BACKGROUND OF THE INVENTION

This invention relates to an apparatus for hardening a steel pipe, and more particularly, to an apparatus for quenching a hot steel pipe by providing longitudinally flowing coolant streams outside and inside the steel pipe.

As is well known in the art, an apparatus for hardening a steel pipe by quenching must meet the following requirements. From a functional aspect, (1) the cooling capacity must be sufficiently high or a sufficiently high rate of cooling must be ensured for thick-walled steel pipes and (2) the cooling rate must be constant over the entire length of steel pipes to prevent formation of soft spots. From an installation aspect, low initial investment and operating cost, easy maintenance, and easy adaptability to different diameters of steel pipes are necessary.

The prior art steel pipe hardening apparatus may be generally classified into two groups; one is the so-called ring-type hardening apparatus of the type wherein a plurality of high-pressure injection nozzles are circumferentially arranged about a steel pipe to inject a liquid coolant, for example, cooling water under pressure toward the outer surface of the steel pipe, and the other is the so-called immersion hardening apparatus of the type wherein a steel pipe is introduced and immersed in a liquid coolant, for example, cooling water in a cooling tank. The ring-type hardening apparatus have disadvantages that the cooling capacity is lower as compared with the immersion hardening apparatus and the inner surface of a thick-walled steel pipe experiences a reduced rate of cooling because in general, only the outer surface is cooled with water. In order to achieve an extra cooling at the inner surface of a steel pipe in addition to outside cooling in the ring-type hardening apparatus, it has been practised to insert a header having an injection nozzle into the steel pipe. However, this method is difficult to apply to steel pipes having a relatively small inner diameter. Since insertion and removal of the header into and out of a steel pipe must be repeated for each steel pipe to be hardened, the time required for insertion and removal of the header becomes a limiting factor in increasing the total throughput speed during the successive hardening of a number of steel pipes, resulting in a limited throughput capacity.

On the other hand, the immersion hardening apparatus generally includes means for forcedly agitating a liquid coolant such as cooling water to produce a forced water flow in the cooling tank because spontaneous convection of water only results in a reduced cooling capacity. When a hot steel pipe is introduced into the cooling tank and immersed in cooling water, the transfer of heat energy from the steel pipe surface to the adjoining layer of cooling water causes the cooling water to boil to cover the steel pipe surface with a film of steam. Inconveniently, the formation of a steam film results in a considerable reduction in rate of heat transfer between the steel pipe and the cooling water or rate of cooling. As the steam film disperses away from the steel pipe surface, direct heat transfer is established again between the steel pipe and cooling water and convection cooling starts. If the dispersion of a steam film from the steel pipe surface is delayed, the rate of cooling of the steel pipe is reduced below the critical cooling rate for martensite transformation required in normal hardening, failing to achieve effective hardening. It it thus critical for the immersion hardening apparatus that a steam film formed at the steel pipe surface be removed as rapidly as possible to start cooling by ordinary heat transfer and convection. To this end, it is necessary to expose the steel pipe surface to a cooling water stream having a relatively high flow velocity. Such a high-velocity cooling water stream may be produced in the conventional immersion hardening apparatus by means of an arrangement shown in FIG. 20. Referring to FIG. 20, a steel pipe 2 is placed in a cooling tank 1. A plurality of spaced-apart injection nozzles 3 are circumferentially arranged about the steel pipe 2 such that they inject cooling water under high pressure tangentially of the steel pipe 2 to produce an agitating stream 4 circumferentially flowing along the outer surface of the steel pipe 2. In combination of the forced stream flowing outside the steel pipe 2, a longitudinally flowing water stream is produced inside the steel pipe 2 by means of an axial injection nozzle (not shown) at one end of the steel pipe. However, such advanced immersion hardening apparatus still have many problems, particularly associated with the means for producing a forcedly agitating stream.

In producing an agitating stream having a sufficient flow velocity to attain effective quenching, the kinetic energy of a jet stream injected through an injection nozzle is transmitted to static water in the cooling tank to cause the static water to move. Because of low energy efficiency, the injection pressure and flow rate must be undesirably increased. Since a number of injection nozzles must be arranged at small intervals in the longitudinal direction of a steel pipe in order to quench the steel pipe uniformly over its entire length, the apparatus becomes more complicated and expensive. Furthermore, injection nozzles arranged about a steel pipe tend to be blocked with scales such as chips of an oxide coating peeling from the steel pipe surface as well as deposits from water, and as a result, the cooling capacity is locally reduced to form soft spots. In order to effectively cool a steel pipe from its outside by producing a circumferentially flowing water stream along the outer surface of the steel pipe, the width of a support for supporting the steel pipe in the cooling tank, more specifically, the width of a support in the longitudinal direction of the steel pipe should be small enough to reduce the resistance to the circumferentially flowing stream by the support. With a reduced width of the support, the steel pipe will experience an increased impact stress when it is thrown into the cooling tank and falls to the support. The steel pipe is often impaired at the surface by such collision. Another problem is to discharge heated water. In the above-described prior art immersion hardening apparatus, the cooling water which has completed quenching of the steel pipe is discharged by allowing it to pass an overflow weir of the cooling tank. However, the prior art immersion hardening apparatus of the above-described construction is difficult to selectively discharge only the heated cooling water, resulting in a reduced rate of cooling.

An apparatus for hardening a long steel pipe is disclosed in Franceschina et al. U.S. Pat. No. 3,877,685 (issued Apr. 15, 1975). The steel hardening apparatus of this U.S. Patent comprises a container dimensioned to receive a hot steel pipe to be hardened, means for supporting the hot pipe in a predetermined position in the container, a nozzle for introducing cooling water into the pipe, means for moving the nozzle between a retracted position in which the tip thereof is spaced from one end of the pipe and an expanded position in which the tip lies within the one end of the pipe, inlet means for introducing cooling water into the container so as to pass into and around the pipe, and isolator means movable in relation to the nozzle. The tip of the nozzle is inserted into the end of the pipe received in the container before cooling water is supplied into the container through the inlet means so as to pass into and around the pipe. The isolator means may be moved to regulate the flow rate of cooling water flowing outside the pipe.

Although the above-mentioned apparatus allows cooling water to pass into and around a steel pipe to be hardened, the steel pipe is simply located and supported in the container. Since no flow path is defined outside the steel pipe for the passage of cooling water it cannot be expected that cooling water supplied around the pipe will flow parallel to the central axis of the pipe to the back end of the pipe. Rather, a turbulent flow is often induced and particularly, the flow velocity varies in the circumferential dirction because the outside flow path is open or it forms an open channel. The turbulent flow and varying flow velocity will cause serious problems. The steel pipe would be locally covered with a film of steam resulting from evaporation of cooling water, and/or heated cooling water which has taken up heat from the steel pipe would stagnate on some part of the steel pipe. As a result, the steel pipe is not uniformly quenched over its entire length, resulting in formation of soft spots and deformation, particularly extreme bending of the pipe. The isolator means is moved in relation to the nozzle to regulate the flow rate of cooling water flowing outside the steel pipe. In addition, the above-mentioned apparatus is complicated and expensive as a whole.

The present invention is based on the recognition that the method for hardening a hot steel pipe by supplying cooling water so as to pass into and around the steel pipe is advantageous over the prior art methods. The inventors have completed the present invention through further researches to develop an apparatus for carrying out this method under optimum conditions.

It is, therefore, a primary object of the present invention to provide an apparatus for hardening a steel pipe by injecting a liquid coolant so as to pass into and around the steel pipe in the longitudinal direction thereof whereby thick-walled steel pipes can be uniformly hardened without forming soft spots and cracks.

It is another object of the present invention to provide a steel pipe hardening apparatus in which a steel pipe to be hardened is received in a cylindrical assembly which can be opened or closed for insertion and removal of the steel pipe, and cooling water flows through flow paths defined outside and inside the steel pipe in the cylindrical assembly.

A further object of the present invention is to provide a steel pipe hardening apparatus of the above-mentioned type in which the cylindrical assembly is opened to prevent damage to the cylindrical assembly and/or the steel pipe when the steel pipe extremely bends within the cylindrical assembly.

A still further object of the present invention is to provide a steel pipe hardening apparatus in which the inner diameter of the cylindrical assembly can be changed so as to match with the outer diameter of a steel pipe to be hardened.

An additional object of the present invention is to provide a steel pipe hardening apparatus capable of continuously hardening steel pipes.

SUMMARY OF THE INVENTION

According to the present invention, there is provided an apparatus for hardening a steel pipe by quenching it with a liquid coolant, which comprises an elongated cylindrical assembly including a casing and a cover removably mated with the casing to define a cylindrical space therebetween for receiving the steel pipe therein. The cover is removable from the casing to allow insertion and removal of the steel pipe. Support means is disposed within the cylindrical assembly for supporting the steel pipe with its central axis being parallel to the central axis of the cylindrical assembly. Injection means is disposed adjacent one end of the cylindrical assembly for injecting the coolant into and around the the steel pipe in the cylindrical assembly in the longitudinal direction thereof.

Since the steel pipe hardening apparatus of the present invention uses the cylindrical assembly to define a flow path for the coolant between the cylindrical assembly and the steel pipe as well as a flow path for the coolant defined inside the steel pipe, a stream of the coolant injected outside the steel pipe flows longitudinally from the one end to the other end of the steel pipe without forming a turbulent flow. A film of vapor formed as a result of evaporation of the coolant and heated coolant which has taken up heat from the steel pipe are instantaneously flushed away. The steel pipe is thus uniformly and rapidly quenched.

In a preferred embodiment of the present steel pipe hardening apparatus, both the casing and cover are semi-circular in cross section. The casing opens vertically upward while the cover opens vertically downward. The casing is provided with a pair of flanges extending radially from the open edges and longitudinally of the casing, and the cover is also provided with a pair of flanges extending radially from the open edges and longitudinally of the cover. At least one pair of clamp arms are pivotably mounted on the outer surface of the cover, each clamp arm having at one end a jaw adapted to engage with the casing flange at the lower surface to clamp the casing to the cover. The casing flange and the clamp arm jaw are configured such that when the steel pipe bends to apply spreading forces to the casing and cover, the clamp arm jaw is disengaged from the casing flange to release the clamp arm. An oil hydraulic circuit for actuating a hydraulic cylinder for driving the clamp arm is provided. The hydraulic circuit includes a detector for detecting the pressure in the hydraulic cylinder and generating an alarm signal when the detected pressure exceeds a predetermined pressure. When the steel pipe in the cylindrical assembly extremely bends during cooling, it applies forces to the casing and cover to spread them away. The displacement of the casing is converted into an increase of pressure in the hydraulic cylinder by way of the clamp arm. Since an abnormal bending of the steel pipe during quenching is detectable as a pressure increase in the hydraulic cylinder, the cylindrical assembly may be protected from being impaired according to this preferred embodiment of the present steel pipe hardening apparatus.

In another preferred embodiment of the present invention, the casing consists of an elongated semi-cylindrical outer case and an elongated semi-cylindrical inner case detachably mounted within the outer case, and the cover consists of an elongated semi-cylindrical outer cover and an elongated semi-cylindrical inner cover detachably mounted within the outer cover. Since a proper set of the inner case and the inner cover may be selected which form a cylindrical container dimensioned so as to match with the outer diameter of a steel pipe to be hardened, hardening of the steel pipe is accomplished without the need for pumping an excessively large volume of coolant.

In a further preferred embodiment of the present invention, at least one rotor is fixedly mounted on a horizontal rotatable shaft. A plurality of semi-cylindrical casings are mounted on the rotor so as to extend parallel to the shaft and open radially outward. The shaft is intermittently rotated in one direction so as to position one of the casings right above the shaft. As the shaft rotates a predetermined angle, the hardened steel pipe drops from one of the casings which has been positioned right above the shaft, and at the same time, the next one of the casings comes to a position right above the shaft and ready for receipt of a following steel pipe to be hardened. A number of steel pipes can be continuously hardened in this manner.

BRIEF DESCRIPTION OF THE DRAWINGS

The steel pipe hardening apparatus of the present invention will be more clearly understood by referring to the drawings, in which.

DESCRIPTION OF THE PREFERRED EMBODIMENTS

Figure 1:
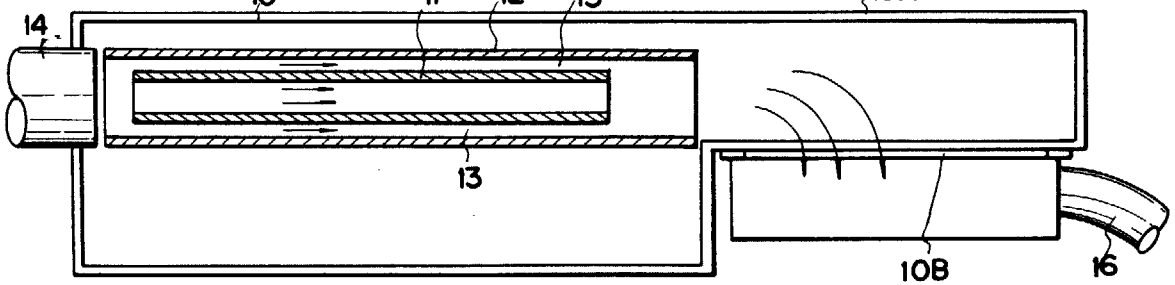
FIG. 1 is a schematic view illustrating a basic arrangement of the steel pipe hardening apparatus according to the present invention.
Figure 20:
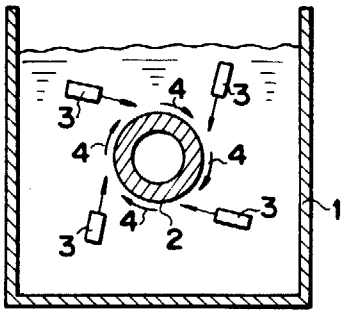
FIG. 20 PRIOR ART
FIG. 20 is a schematic illustration of a prior art immersion hardening apparatus.

Referring to FIG. 1, an apparatus for hardening a steel pipe according to the present invention is schematically shown. In an elongated cooling tank 10 is substantially horizontally disposed an elongated hollow cylindrical assembly 12 which has an inner diameter larger than the outer diameter of a steel pipe 11 to be hardened. The term "longitudinal" direction used herein designates the axial direction of the cylindrical assembly. The term "transverse" direction is a direction perpendicular to the longitudinal direction. In the plane of the sheet of FIG. 1, the longitudinal and transverse directions are left-to-right and upper-to-lower directions, respectively. The cylindrical assembly 12 is provided for the purpose of receiving a hot steel pipe to be hardened. The cylindrical assembly 12 is designed such that it can be opened to allow insertion and removal of a steel pipe and receive the steel pipe with its central axis being parallel to, preferably substantially coincident with the central axis of the cylindrical assembly 12 as will be described below. A space 13 is defined between the outer surface of the steel pipe 11 and the inner surface of the cylindrical assembly 12. This space forms a flow path outside the pipe. Adjacent the inlet (left in FIG. 1) end of the cylindrical assembly 12 is disposed injection means 14 for injecting cooling water into and around the steel pipe whereby water streams flow through the outside flow path 13 and the steel pipe interior and parallel to the axis of the cylindrical assembly 12. The injection means 14 has an open end which is substantially equal in inner diameter to the cylindrical assembly 12. The injection means 14 is designed and disposed such that at least its open end portion is substantially aligned with the cylindrical assembly 12 and the open end is in contact with or adjacent to the inlet end of the cylindrical assembly 12.

The outlet end of the cylindrical assembly 12 which is remote from the injection means 14 is also an open end. The cooling tank 10 is extended in the direction of extension from the outlet of the cylindrical assembly 12 to form an extension 10A. The tank extension 10A is provided at its side wall with an overflow weir 10B over which cooling water flows into a drain 16 affixed outside the weir 10B.

The operation of the apparatus shown in FIG. 1 is as follows. A hot steel pipe is thrown into the cooling tank 10 and received in the cylindrical assembly 12. The injection means 14 injects cooling water into and around the steel pipe 11 to provide axially or longitudinally flowing water streams outside and inside the steel pipe. Since the streams of cooling water flush past the steel pipe toward and beyond its outlet end while taking heat from the steel pipe, the rate of cooling is substantially constant and the steel pipe 11 is substantially uniformly quenched over its entire length.

It is to be noted that the cooling tank 10 is also charged with cooling water and the cylindrical assembly 12 may be located either above or below the level of cooling water in the cooling tank 10. Preferably, the cylindrical assembly 12 is submerged in cooling water in the tank. When a steel pipe is dropped into the cylindrical assembly 12, the cooling water functions as a damping medium to reduce the speed of approach of the dropping steel pipe to the cylindrical assembly 12, thereby preventing damage to the steel pipe surface. In addition, the occurrence of soft spots in a hardened steel pipe is eliminated because cooling water instantaneously enters the steel pipe.

A preferred embodiment of the steel pipe hardening apparatus according to the present invention is illustrated in FIGS. 2 to 16. First referring to FIGS. 2 and 3, an elongated box-like tank 10 is charged with cooling water. The apparatus includes a first rotatable shaft 17 which extends horizontally and longitudinally of the cooling tank 10 and passes through the end walls of the cooling tank 10. One end of the shaft 17 projecting out of the front end wall of the cooling tank 10 is connected to a plunger 18*a* of a hydraulic cylinder 18 through a link 19. An intermediate portion of the shaft 17 which is located within the cooling tank 10 is provided with a plurality of arms 20 longitudinally spaced at given intervals. Each of the arms 20 secured to the shaft 17 has at its free end a standing support portion to which a casing 12 of a semi-circular cross-section forming the lower half of the cylindrical assembly 12 is secured. The casing 21 is held substantially horizontal in cooling water with its concave facing upward when the hydraulic cylinder 18 is at rest. The casing 21 may be turned counterclockwise or downward together with the arms 20 by actuating the hydraulic cylinder 18 to rotate the shaft 17 counterclockwise when viewed in FIG. 3. As apparent from the enlarged view of FIG. 4, the casing 21 consists of a semi-cylindrical outer case 22 fixedly secured to the support portions of the arms 20, and a semi-cylindrical inner case 23 having substantially the same length as the outer case 22 with an outer radius smaller than the inner radius of the outer case 22.

Figure 2:
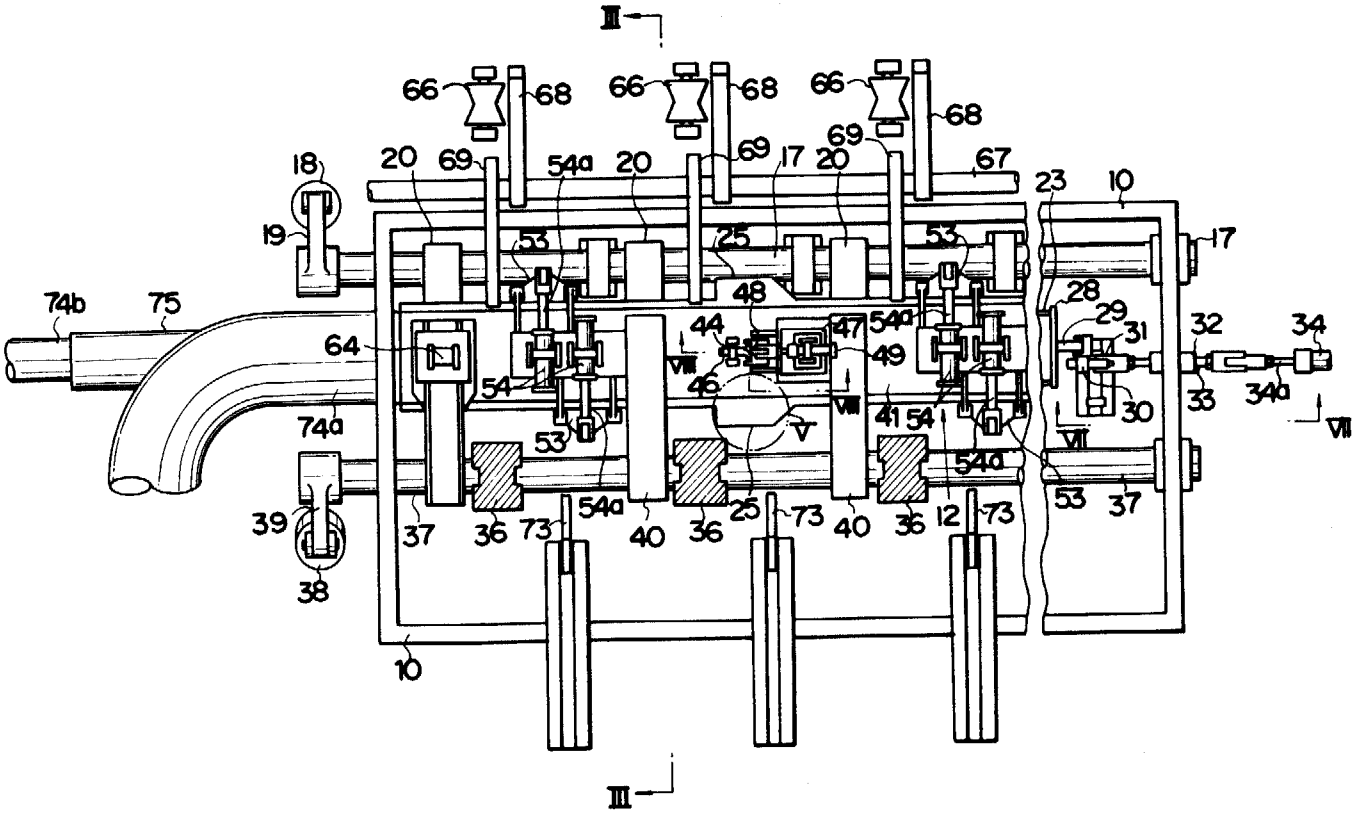
FIG. 2 is a partially cut-away plan view of one embodiment of the present hardening apparatus.
Figure 5:
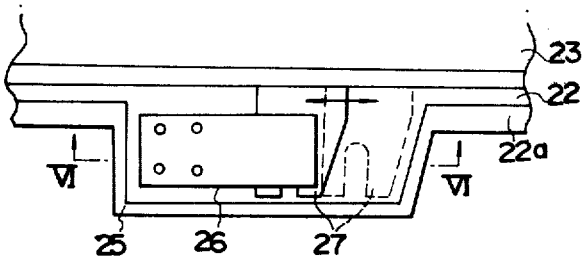
FIG. 5 is an enlarged plan view of the case retaining mechanism enclosed by a circle V in FIG. 2.
Figure 6:
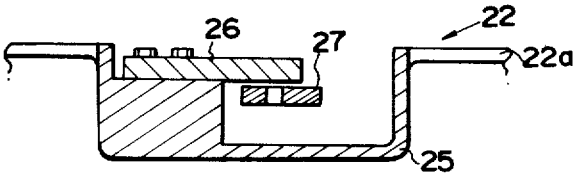
FIG. 6 is a vertical cross section of the case retaining mechanism taken along line VI—VI in FIG. 5.
Figure 7:
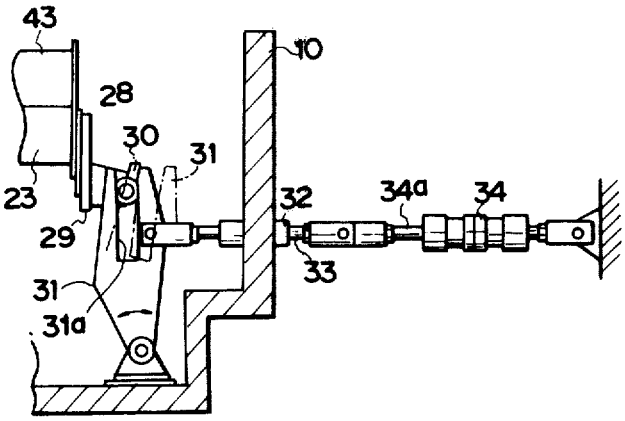
FIG. 7 is a cross-sectional view of the sliding mechanism taken along line VII—VII in FIG. 2.

The inner case 23 forms the lower half of a cylindrical container 24 for receiving therein a steel pipe 11 to be hardened. The inner case 23 is detachably received in the outer case 22 by means of a suitable mount mechanism to be illustrated below. The outer case 22 is provided with plural pairs of radially extending bulges 25 at longitudinally spaced-apart positions. One bulge 25 is shown in FIGS. 5 and 6 as forming a cavity therein. A retainer plate 26 is bolted to a bulge base such that the free end of the retainer plate 26 is spaced apart from the bottom of the cavity. The inner case 23 is provided with corresponding pairs of radially extending keys 27 at longitudinally spaced-apart positions. With this arrangement, the inner case 23 may be fixedly mounted within the outer case 22 by longitudinally sliding the inner case 23 with respect to the outer case to insert the inner case keys 27 below the outer case retainer plates 26 to achieve engagement of these members. On the contrary, the inner case 23 may be detached from the outer case 22 by sliding the inner case 23 in the opposite direction to disengage the keys 27 from the retainer plates 26. Means for sliding the inner case 23 with respect to the outer case 22 is constructed as shown in FIGS. 2 and 7. To the longitudinal outlet end of the inner case 23 is secured an end plate 28 to which a bracket 29 is secured at right angles. A pin 30 extending perpendicular to the longitudinal direction of the inner case 23 is inserted into an opening in the bracket 29. A swing lever 31 is pivotably mounted to the bottom of the cooling tank 10 and extends vertically upward. The swing lever 31 has at the upper end a vertically extending slot 31*a* having a width larger than the diameter of the pin 30. The pin 30 is located within the slot 31*a* in the swing lever 31. The inner case 23 may be longitudinally slided by turning the swing lever 31 clockwise or counterclockwise when viewed in FIG. 7. A provision is made such that when the swing lever 31 is at a neutral position to be described hereinafter, the pin 30 does not contact with the inner edges of the slot 31*a* in the swing lever 31. The swing lever 31 is also pivotably connected to one end of a connecting rod 33 which passes through the rear end wall of the cooling tank 10 via a sealing sleeve 32. The other end of the connecting rod 33 is connected to a piston rod 34*a* of a two-stage hydraulic cylinder 34 by a suitable joint.

Figure 4:
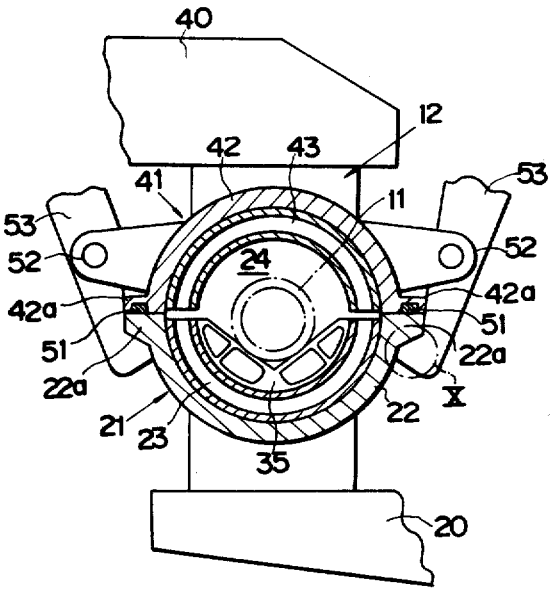
FIG. 4 is an enlarged cross-sectional view showing the cylindrical assembly in the apparatus of FIG. 3.

A plurality of V-shaped supports 35 are disposed within the inner case 23 at given intervals in the longitudinal direction. The supports 35 are in tangential contact with the steel pipe 11 to be hardened and support the steel pipe 11 such that the steel pipe 11 is substantially horizontal and aligned with the outer case 22 and hence, with the cylindrical assembly 12. While each of the supports 35 is V-shaped in transverse cross section as shown in FIG. 4, it is streamlined in longitudinal cross section or in the direction of a stream of cooling water flowing longitudinally of the steel pipe 11 so as to prevent any turbulent flow from occurring in the cooling water stream. In addition, the support 35 is provided with a number of openings for easy access of cooling water to the steel pipe 11, thereby allowing a more volume of cooling water to flow in contact with the steel pipe 11 to promote cooling.

A second rotatable shaft 37 extends horizontally and longitudinally, passes through the end walls of the cooling tank 10, and is rotatably supported by a plurality of suspending arms 36 at given intervals. One end of the shaft 37 projecting out of the front end wall of the cooling tank 10 is connected to a plunger 38*a* of a second hydraulic cylinder 38 through a link 39. An intermediate portion of the shaft 37 which is located within the cooling tank 10 is provided with a plurality of arms 40 longitudinally spaced at given intervals. Each of the arms 40 secured to the shaft 37 has at its free end a suspending support portion to which a cover 41 of a semi-circular cross section forming the cylindrical assembly 12 with the casing 21 is fixedly secured. Therefore, the cylindrical assembly 12 can be selectively opened and closed by actuating the second hydraulic cylinder 38 to rotate the second shaft 37 with the arms 40, thereby turning the cover 41 toward and away from the casing 21.

Figure 8:
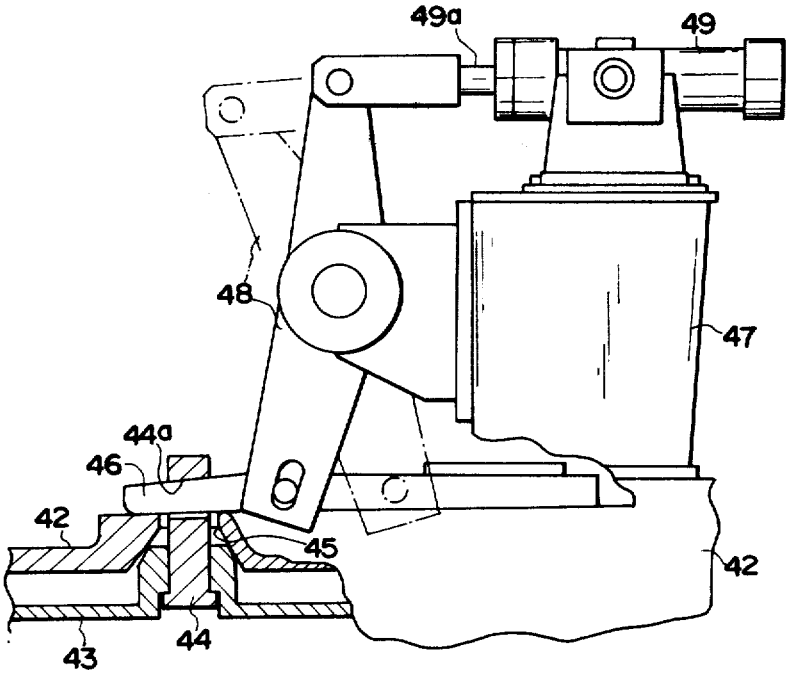
FIG. 8 is an enlarged cross section of the cover locking mechanism taken along line VIII—VIII in FIG. 2.

The cover 41 consists of a semi-cylindrical outer cover 42 fixedly secured to the support portions of the arms 40 with its concave facing vertically downward, and a semi-cylindrical inner cover 43 having substantially the same length as the outer cover 42 and an outer radius smaller than the inner radius of the outer cover 42. The inner cover 43 and the above-mentioned inner case 23 form the cylindrical container 24 for receiving the steel pipe 11 therein. The inner cover 43 is detachably received in the outer cover 42 by means of a suitable locking mechanism to be illustrated below. The inner cover 43 is provided with a plurality of openings at longitudinally spaced-apart positions. A locking pin 44 having a through-hole 44*a* at the upper portion is vertically upward inserted into the opening as shown in FIG. 8. The outer cover 42 is provided with an opening 45 at a position corresponding to the opening in the inner cover 43 so that the locking pin 44 may pass through the outer cover opening 45. On the upper surface of the outer cover 42 is movably disposed a cotter 46 which is to be inserted into the through-hole 44*a* in the upper portion of the locking pin 44 above the outer cover 42. A lever 48 at the center is pivotably mounted to a mount base 47 on the upper surface of the outer cover 42. The lower end of the lever 48 is pivotably connected to the cotter 46 and the upper end thereof is pivotably connected to a plunger 49*a* of a hydraulic cylinder 49 affixed to the upper surface of the mount base 47. By actuating the hydraulic cylinder 49 to turn the lever 48 clockwise when viewed in FIG. 8, the cotter 46 is inserted into the through-hole 44*a* in the locking pin 44 to fixedly secure the inner cover 43 to the outer cover 42. The inner cover 43 may be detached from the outer cover 43 if the hydraulic cylinder 49 is reversely actuated to turn the lever 48 counterclockwise to withdraw the cotter 46 from the through-hole 44*a* in the locking pin 44.

Figure 9:
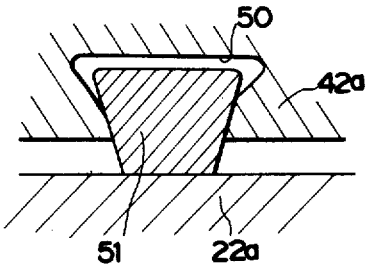
FIG. 9 is an enlarged cross section of a channel in a cover flange having a sealing member fitted therein.

The abutting edges of the casing 21 and the cover 41, that is, the right and left side edges of both the outer case 22 and outer cover 42 in FIG. 4 are provided with flanges 22*a* and 42*a* extending radially and longitudinally of the cylindrical assembly 12, respectively. A longitudinally extending channel 50 is formed in the lower surface of the outer cover flange 42*a*, that is, the surface of the cover 41 in abutment with the casing 21. The cross-sectional shape of this channel 50 is shown in the enlarged view of FIG. 9. An elastic sealing member 51 is in close fit with the channel 50. The sealing member 51 is formed of natural or synthetic rubber and expands to partly protrude out of the channel 50 in an uncompressed condition as shown in FIG. 9. Thus the sealing member 51 provides an effective seal between the casing 21 and the cover 41 even when the casing 21 is spaced a short distance from the cover 41.

Figure 3:
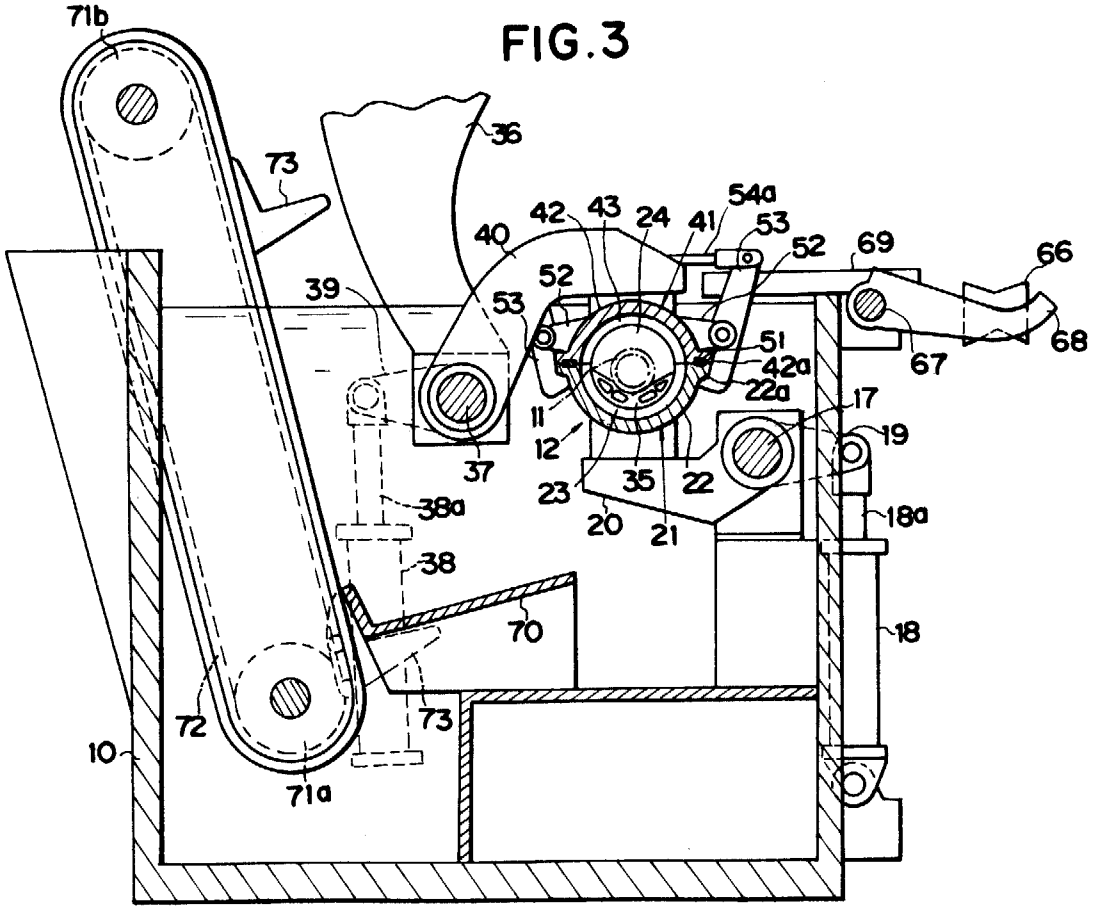
FIG. 3 is a transverse cross-sectional view of the apparatus taken along line III—III in FIG. 2.

The outer cover 42 at its outer surface is provided with plural pairs of oppositely extending brackets 52 at longitudinally spaced-apart positions as shown in FIGS. 2 and 3. A clamp arm 53 at its intermediate portion is pivotably mounted to each of the brackets 52. The clamp arm 53 has at one end a jaw which engages the flange 22*a* of the outer case 22 at the lower surface to clamp the outer case 22 to the outer cover 42. A clamping hydraulic cylinder 54 mounted on the outer cover 42 has a plunger 54*a* which is pivotably connected to the other end of the clamp arm 53.

Figure 10:
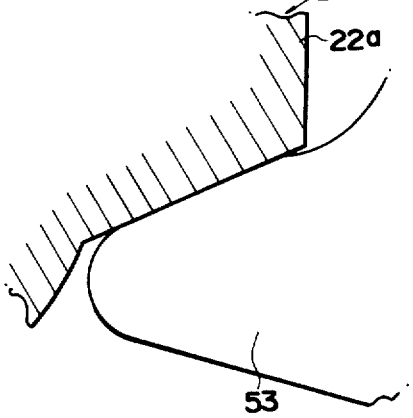
FIG. 10 is an enlarged view of a clamp arm in engagement with an outer case flange enclosed by a circle X in FIG. 4.

The jaw of the clamp arm 53 in engagement with the flange 22*a* of the outer case 22 is illustrated in the enlarged view of FIG. 10. The lower surface of the outer case flange 22*a* is at an angle with respect to the horizontal line or slanted upward and toward the flange edge. The upper surface of the clamp arm jaw is correspondingly slanted. Differently stated, the engaging surfaces of the outer case flange 22*a* and the clamp arm jaw are slanted such that when the outer cover 42 and the outer case 22 are spread away from each other, the clamp arm 53 will receive a component of the spreading force which acts to urge the arm toward the clamp cancelling direction.

Figure 11:
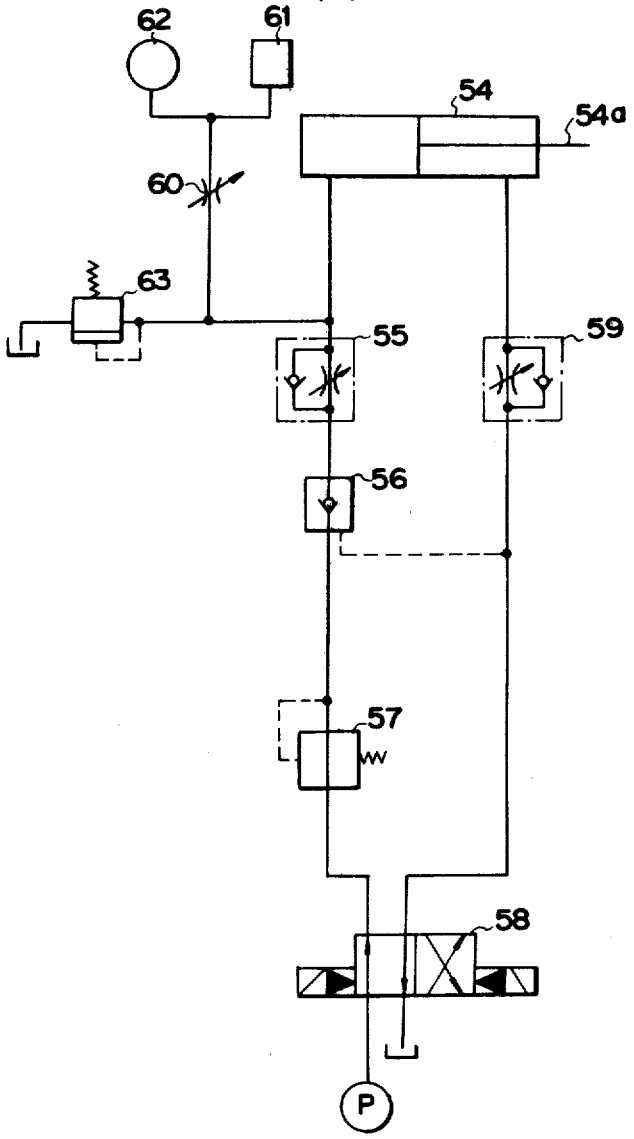
FIG. 11 is a diagram showing an oil hydraulic circuit for actuating a clamping hydraulic cylinder.

An oil hydraulic circuit for actuating the clamping hydraulic cylinder 54 is illustrated in FIG. 11. A rear port of the clamping hydraulic cylinder 54 is in fluid communication with a flow control valve 55 having a check valve built therein, and then with a pilot check valve 56 which is in fluid communication with a selector valve 58 through a pressure reducing valve 57. A front port of the clamping hydraulic cylinder 54 is in fluid communication with the selector valve 58 through another flow control valve 59 having a check valve built therein. A supply of oil under pressure into the cylinder 54 through the rear port causes the plunger 54*a* to move forward, placing the clamp arm 53 into the clamping position. On the contrary, a supply of oil under pressure into the cylinder 54 through the front port causes the plunger 54*a* to retract, placing the clamp arm 53 into the release position. The line connecting the rear port and the flow control valve 55 has a branch line to a parallel connection of a pressure switch 61 and a pressure gauge 62 through a throttling valve 60. When the pressure of oil at the rear side of the piston in the clamping hydraulic cylinder 54 is increased above a predetermined level preset in the pressure switch 61 as a result of retraction of the plunger 54*a*, the pressure switch 61 generates an alarm signal which is supplied to the selector valve 58. Then the selector valve 58 is reversed to actuate the clamping hydraulic cylinder 54 toward release action. A relief valve 63 is also connected to the branch line.

Figure 12:
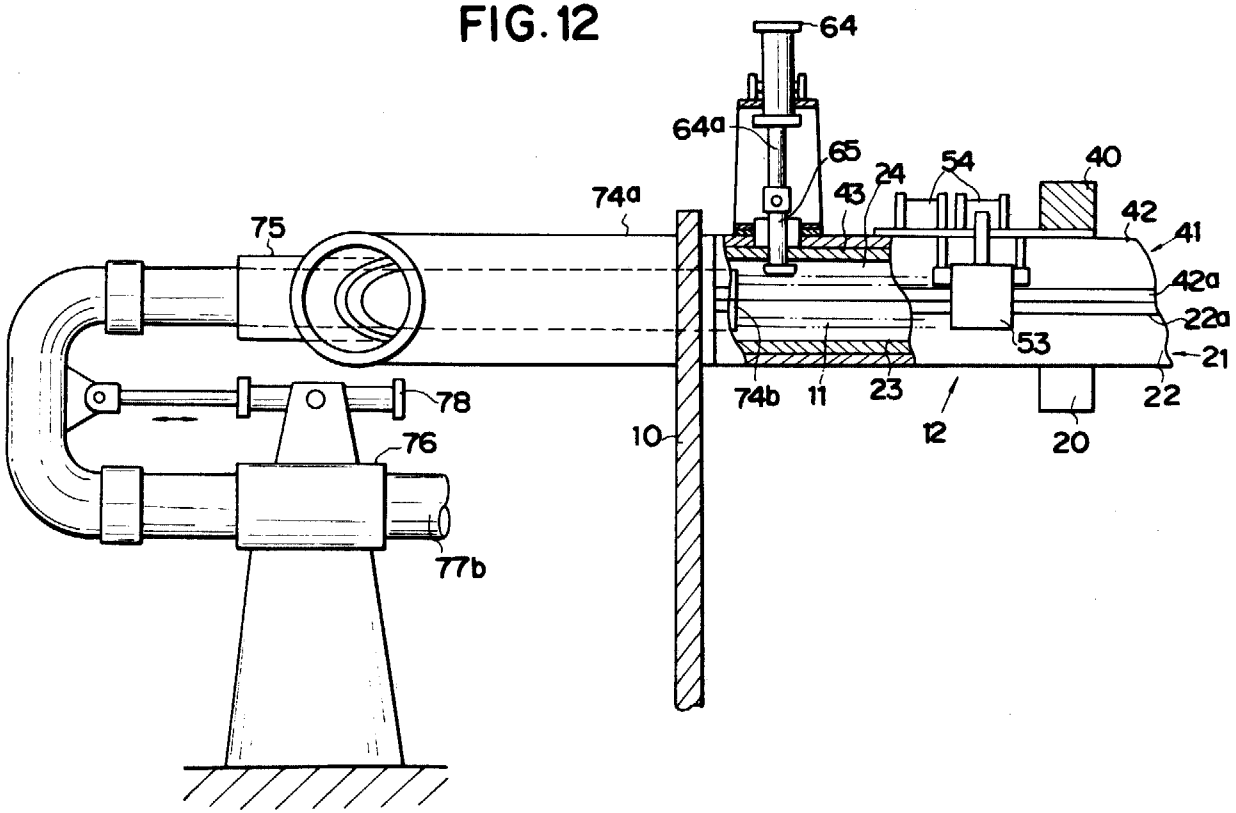
FIG. 12 is a side elevation of the apparatus, particularly illustrating outer and inner nozzles and the cylindrical assembly.

On the inlet end of the outer cover 42 is mounted a retaining hydraulic cylinder 64 by means of a suitable mount as shown in FIG. 12. The hydraulic cylinder 64 has a vertically downward extending plunger 64*a* connected to a retaining rod 65 which extends through the outer and inner covers 42 and 43. The retaining rod 65 at the lower end abuts against the steel pipe 11 to retain the steel pipe 11 in place on the supports 35 in the inner case 23.

Outside the cooling tank 10 are longitudinally arranged a series of conveyor rollers 66 for conveying a hot steel pipe 11 from the preceding station to the present hardening apparatus. On the same side of the cooling tank 10 as the rollers 66 are arranged, a longitudinally extending third shaft 67 is rotatably mounted to the upper portion of the side wall of the cooling tank 10. A plurality of transfer arms 68 are fixedly secured on the shaft 67 at given intervals. The transfer arms 68 extend transversely and their free ends reach at least a vertical plane including the rollers 66. A plurality of loading skids 69 are secured at given intervals to the upper portion of the tank side wall to which the third shaft 67 is rotatably mounted. The skids 69 extend from the outside of the cooling tank 10 to above the cylindrical assembly 12 and are slightly downward slanted toward the cylindrical assembly 12. A hot steel pipe 11 which has been conveyed to the side-by-side position of the cooling tank 10 may be transferred onto the skids 69 by rotating the shaft 67 with the transfer arms 68 counterclockwise when viewed in FIG. 3. The thus transferred steel pipe 11 will roll along the slant skids 69 and tumble down onto the cylindrical assembly 12.

Furthermore, a plurality of discharging skids 70 which are slightly downward slanted to the left when viewed in FIG. 3 are mounted on the bottom of the cooling tank 10 so that they can receive a hardened steel pipe dropping from the casing 21. A sprocket 71*a* is disposed adjacent the lower end of the discharging skids 70 and another sprocket 71*b* is disposed above the other side wall of the cooling tank 10. A chain 72 is trained around these sprockets 71*a* and 71*b*. The chain 72 bears a series of chain dogs 73 for carrying the steel pipe 11 which has rolled down to the lower end of the discharging skids 70 out of the cooling tank 10 with the corresponding chain dogs 73 on the remaining chains 72.

An outer nozzle 74*a* in the form of a large-diameter pipe having an open end which is equal in inner diameter to the above-mentioned cylindrical container 24 is attached to the inlet end wall of the cooling tank 10 such that at least the open end portion of the nozzle is substantially aligned with the cylindrical assembly 12 and the open end is in contact or close proximity with the open end of the cylindrical assembly 12. An inner nozzle 74b in the form of a small-diameter pipe is coaxially disposed within the outer nozzle 74a. This inner nozzle 74b is sized such that the open end has inner and outer diameters substantially equal to those of the steel pipe 11 to be hardened. The inner nozzle 74b is inserted into the outer nozzle 74a through a sealing sleeve 75 fitted in an opening in the curved wall of the outer nozzle 74a. The inner nozzle 74b is located such that the open end portion may be aligned with the steel pipe 11. Furthermore, the inner nozzle 74b is U-shaped as a whole as shown in FIG. 12 and has an upstream end which is slidably inserted into a water supply main pipe 77b via another sealing sleeve 76. As shown in FIG. 12, the leg portions of the U-shaped nozzle pipe 74b are placed horizontal and the vertically standing intermediate portion is connected to a plunger of a positioning hydraulic cylinder 78 horizontally mounted on a suitable base. By actuating the cylinder 78, the U-shaped nozzle pipe 74b is horizontally moved back and forth and hence, the outlet end of the nozzle 74b is moved toward and away from the open end of the steel pipe 11 in the cylindrical assembly 12.

Figure 13A:
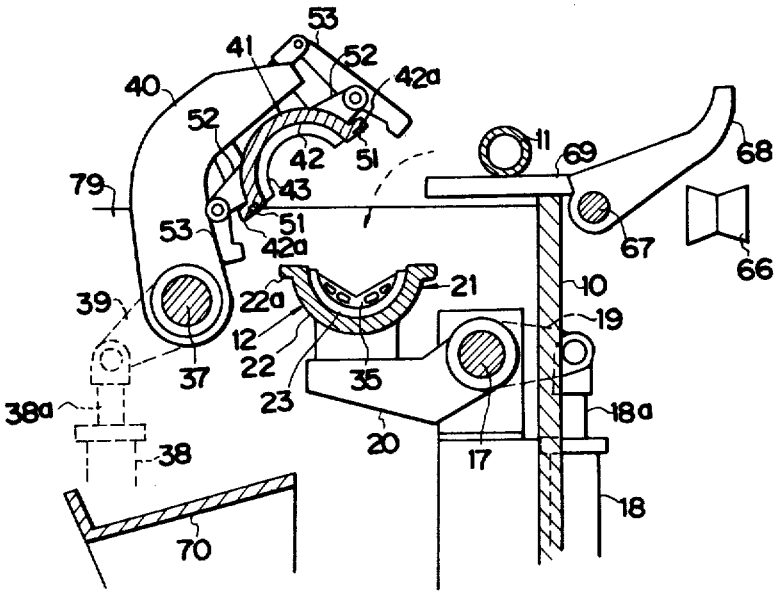
FIG. 13A, 13B and 13C illustrate different stages of operation of the casing and cover.
Figure 13B:
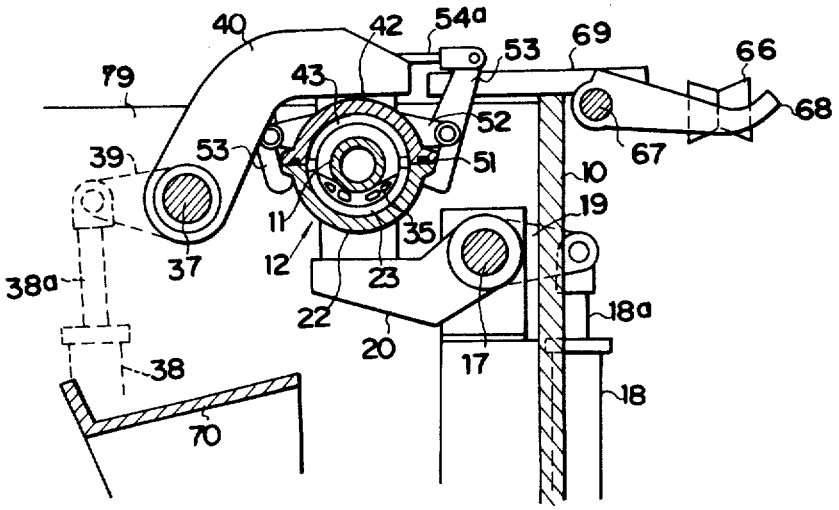

In order to quench steel pipes, the above-mentioned steel pipe hardening apparatus is operated as follows. First, the cover 41 is lifted to open the cylindrical assembly 12 by actuating the second hydraulic cylinder 38 to turn the arm 40 counterclockwise as shown in FIG. 13A. Then a hot steel pipe 11 which has been conveyed in place on the conveyor rollers 66 is transferred onto the loading skids 69 by turning the transfer arms 68 counterclockwise. The steel pipe 11 rolls along the loading skids 69 and tumbles into the cooling tank 10. The steel pipe 11 is thus placed on the supports 35 within the casing 21. At this point, the inner nozzle 74b has previously been retracted by means of the positioning hydraulic cylinder 78 in order to prevent the dropping steel pipe 11 from striking the inner nozzle 74b. In addition, cooling water is slowly injected through the outer and inner nozzles 74a and 74b to cause cooling water 79 to flow in the forward direction in the cooling tank 10 in order to purge air within the dropping steel pipe 11 as rapidly as possible. Thereafter, the second hydraulic cylinder 38 is actuated to turn the shaft 37 with the arm 40 and the cover 41 clockwise to place the cover 41 in mating engagement with the casing 21 to close the cylindrical assembly 12 as shown in FIG. 13B. The clamping hydraulic cylinders 54 are then actuated to bring the clamp arms 53 into engagement with the flanges 22a of the casing 21, thereby clamping the casing 21 and the cover 41 into an assembly. Since the steel pipe 11 supported by the supports 35 is substantially aligned with the cylindrical assembly 12 (or at least the central axis of the steel pipe is parallel to the central axis of the cylindrical assembly), the outside flow path 13 is defined around the steel pipe 11. After the cylindrical assembly 12 is loaded with the steel pipe 11 as described above, the retaining hydraulic cylinder 64 is actuated to move the retaining rod 65 forward to urge the steel pipe 11 against the supports 35, thereby retaining the steel pipe 11. In addition, the positioning hydraulic cylinder 78 is actuated to move the inner nozzle 74b forward to place its open end in contact or close proximity with the open end of the steel pipe 11. In this condition, the flow rates of cooling water injected through the outer and inner nozzles 74a and 74b are increased to the predetermined maximum levels. Then jet streams of cooling water 79 longitudinally flow outside and inside the steel pipe 11 in the cylindrical assembly 12 to quench the steel pipe 11 for hardening. The distributions of flow velocity of water stream in the proximity of the steel pipe outer and inner surfaces are constant at any points because cooling water 79 flows longitudinally of the steel pipe 11. The steel pipe 11 is substantially uniformly quenched as a whole, precluding formation of soft spots, quenching cracks or the like.

A brief explanation will be made on the rates of cooling or the flow rates of cooling water at the outside and inside of the steel pipe 11. Provided that the cross sectional area of the flow path outside the steel pipe 11 is larger than the required minimum area, that the cross sectional area of the flow path outside the steel pipe 11 is substantially equal to the cross sectional area of the flow path inside the steel pipe, that the inner nozzle 74b has the same outer and inner diameters as the steel pipe 11, that the open end of the inner nozzle 74b is substantially in contact with the open end of the steel pipe 11, and that the flow paths of cooling water are clearly discriminated outside and inside the steel pipe 11, it is estimated that the ratio of the flow rate of cooling water flowing outside the steel pipe 11 to the flow rate of cooling water flowing inside the steel pipe 11 may be approximately 1. However, since steel composition, coefficient of heat transfer, steam films, and oxide coatings formed during preceding rolling or heat treatment are not necessarily the same between the outer and inner surfaces of the steel pipe 11, the flow rate of cooling water flowing outside the steel pipe 11 is preferably set higher than the flow rate of cooling water flowing inside the steel pipe 11 in order to prevent deformation due to thermal stresses during cooling. Such proper flow rates may be determined through experiments.

Figure 14:
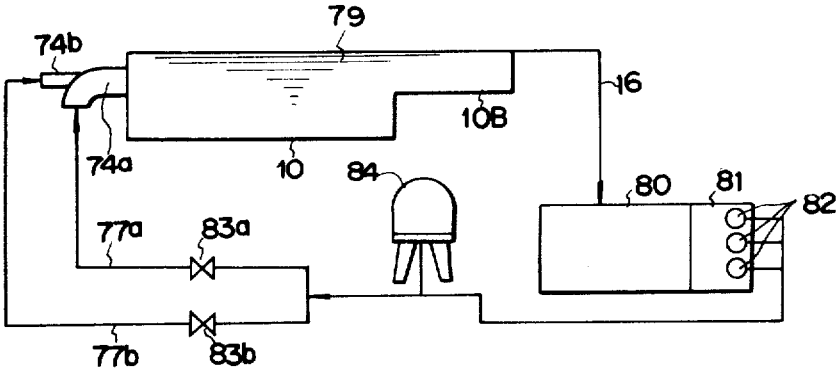
FIG. 14 is a diagram showing a system for circulating cooling water.

Next, a circuit for circulating cooling water is described. In FIG. 14, cooling water in the cooling tank 10 including water discharged from the outlet of the cylindrical assembly is generally designated at 79. Water flows over the overflow weir 10B of the cooling tank 10 into the drain 16. This overflow is temporarily reserved in a special pit 80 and then air cooled in a cooling column 81. The thus cooled water is pumped by means of pumps 82 through main water supply pipes 77a and 77b including flow control valves 83a and 83b to the outer and inner nozzles 74a and 74b, respectively, where water is injected again into the cylindrical assembly. Provision of an overhead tank 84 at the discharge side of the pumps 82 is effective to obtain a sufficient pressure and flow rate to inject water without increasing the capacity of the pumps 82 because the water head by the overhead tank 84 assists the pumps 82 in achieving sufficient flow rates of water under pressure. The flow rate of water to be injected through the outer and inner nozzles 74a and 74b may be individually controlled by means of the valves 83a and 83b. Optimum flow rates may be easily achieved for both the nozzles.

It is to be noted that longitudinal movement of the steel pipe 11 is inhibited during hardening or injection of cooling water through the outer and inner nozzles 74a and 74b because the steel pipe 11 is held fixed by means of the retaining rod 65.

Figure 13C:
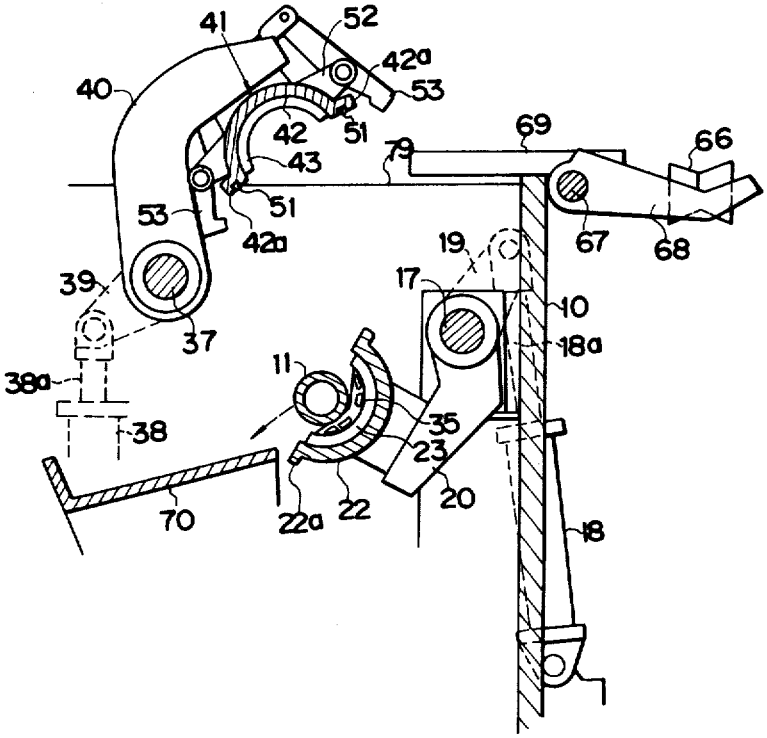

After hardening of the steel pipe 11 is carried out for a given time, for example, several ten seconds, the flow rates of cooling water injected through the outer and inner nozzles 74a and 74b are reduced. At the same time, the clamping hydraulic cylinder 54 is reversely actuated to release the clamp arm 53. As shown in FIG. 13C, the second hydraulic cylinder 38 is actuated to lift the cover 41 to open the cylindrical assembly 12 and the first hydraulic cylinder 18 is actuated to turn the casing 21 with the arm 20 counterclockwise. Then, the hardened steel pipe 11 drops from the supports 35 onto the discharging skids 70 and rolls along the discharging skids 70 to the lower end thereof. The steel pipe 11 is then lifted by means of the chain dogs 73 out of the cooling tank 10 to suitable take-out means such as a series of conveyor rollers (not shown). While the steel pipe 11 is being lifted by the chain dogs 73, the casing 21 is restored to the initial position shown in FIG. 13A through the reverse operation of the first hydraulic cylinder 18. The casing 21 restored to the initial position is ready for receiving a following hot steel pipe. The process of hardening a steel pipe is completed in this manner and will be repeated for successive hardening.

When a hot steel pipe is hardened as described above, it is required that the inner diameter of the cylindrical container 24 be matched with the outer diameter of the steel pipe in order to prevent the flow rate of water outside the steel pipe from undesirably increasing. This means that the inner diameter of the cylindrical container 24 should be increased when relatively large-diameter steel pipes are hardened and reduced when relatively small-diameter steel pipes are hardened. To this end, plural sets of the inner cases 23 and the inner covers 43 having different radii of curvature at their inner surface are prepared. A proper set of an inner case and an inner cover matching with the outer diameter of a steel pipe to be hardened may be chosen among these sets and mounted in the outer case 22 and the outer cover 42, respectively. In the above-mentioned steel pipe hardening apparatus, the inner case 23 and the inner cover 43 may be exchanged in the following manner.

Figure 15A:
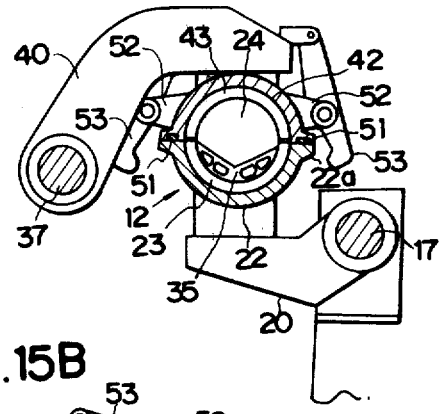
FIGS. 15A and 15B illustrate different stages of a process of withdrawing a set of inner case and cover.
Figure 15B:
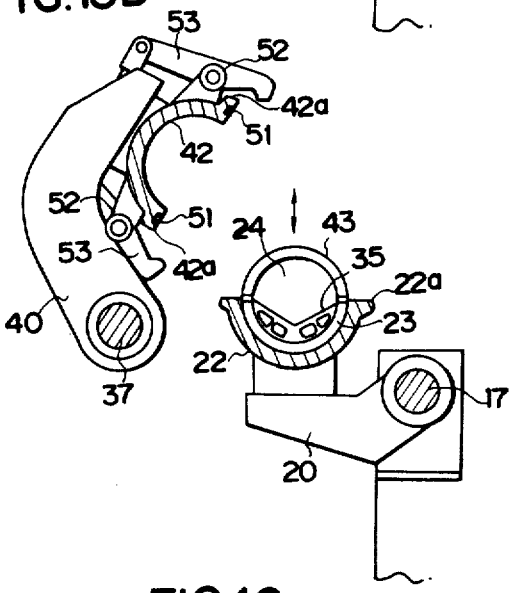

First, removal of the inner case 23 and inner cover 43 from the outer case 22 and outer cover 42 is explained. In the assembled condition, the casing 21 is held horizontal in the cooling tank 10 and the cover 41 is placed on the casing 21 in a mating relationship as shown in FIG. 15A. Now, the hydraulic cylinder 49 is actuated to retract the cotter 46 out of the through-hole 44a in the locking pin 44. The inner cover 43 is then unlocked from the outer cover 42. Next, as shown in FIG. 15B, the second hydraulic cylinder 38 is actuated to turn the second shaft 37 with the arm 40 and the outer cover 42 counterclockwise. Since the inner cover 43 has been unlocked from the outer cover 42, only the outer cover 42 is lifted with the turning arm 40 and the inner cover 43 is left on the inner case 23. Next, the two stage cylinder 34 located outside the rear end wall of the cooling tank 10 is actuated to turn the swing lever 31 clockwise when viewed in FIG. 7 to slide the inner case 23 and the inner cover 43 to the right when viewed in FIG. 7, thereby disengaging the keys 27 of the inner case 23 from the retainer plates 26 secured in the bulges 25 of the outer case 22. The inner case 23 is thus disengaged from the outer case 22. An assembly of the inner case 23 and the inner cover 43 can now be removed from the outer case 22. For removal of the assembly of the inner case 23 and the inner cover 43, a crane (not shown) may be used to lift the assembly in the direction shown by an arrow in FIG. 15B. At this point, the outer cover 42 should be further turned away to a position where it does not disturb lifting of the inner case-cover assembly. In addition, the swing lever 31 is slightly retracted to the neutral position where the swing lever 31 does not contact with the pin 30, thereby placing the pin free from the swing lever 31.

The inner case 23 and the inner cover 43 may be mounted to the outer case 22 and the outer cover 42 by following the above-mentioned procedures in the reverse order. With the cylindrical assembly 12 opened as shown in FIG. 15B, a new set of the inner case 23 and the inner cover 43 is first introduced into the outer case 22. The swing lever 31 is then turned counterclockwise in FIG. 7 to slide the inner case 23 and the inner cover 43 to the left in FIG. 7. The keys 27 of the inner case 23 are moved below the retainer plates 26 secured in the bulges 25 of the outer case 22, thereby securing inner case 23 to the outer case 22. Next, the outer cover 42 is turned back so as to mate with the outer case 22. The locking pin 44 standing on the inner cover 43 is inserted into the opening 45 in the outer cover 42 and protruded beyond the outer cover 42. The hydraulic cylinder 49 is actuated to insert the cotter 46 into the through-hole 44a in the locking pin 44, thereby securing the inner cover 43 to the outer cover 42. After the above-mentioned mounting procedure is completed, the swing lever 31 is slightly turned clockwise in FIG. 7 to bring the swing lever 31 out of contact with the pin 30 because the pin 30 would otherwise interfere with the swing lever 31 when the casing 21 is turned about the axis of the first shaft 17 in the subsequent stage.

By exchanging a new set of the inner case 23 and the inner cover 43 to form a new cylindrical container 24 having an inner diameter matched with the outer diameter of a steel pipe to be quenched, it can be avoided that the flow rate of cooling water flowing outside the steel pipe would become undesirably excessive or short. Therefore, the power required to inject cooling water may be optimized and the operating cost may be reduced.

Figure 16:
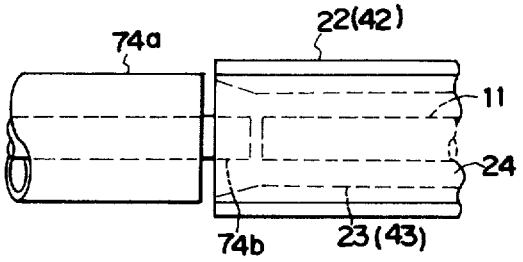
FIG. 16 is a schematic view showing the position of the open ends of outer and inner nozzles in relation to the cylindrical assembly having a steel pipe received.

When the inner case 23 and the inner cover 43 are exchanged by new ones to change the inner diameter of the cylindrical container 24, the open end of the outer nozzle 74a is in correct abutment with the end of the cylindrical container 24 if the inlet end portions of the inner case 23 and the inner cover 43 which face the outer nozzle 74a are tapered as shown in FIG. 16. However, the central axis of the open end portion of the inner nozzle 74b will be off the central axis of the steel pipe 11 because of its different diameter. If cooling water is injected through the inner nozzle 74b under this condition, a turbulent flow would occur in the cooling water stream to render it difficult to provide longitudinally flowing cooling water streams, eventually impairing the hardening effect. In order to eliminate such a problem, the tip portion of the inner nozzle 74b may be exchanged simultaneous with the exchange of the inner case 23 and the inner cover 43 so that the open end portion of the inner nozzle 74b may correctly mate with the open end of the steel pipe 11.

In the quenching of the steel pipe 11 by providing longitudinally flowing cooling water streams to the outside and inside of the steel pipe 11, the steel pipe 11 would bend due to a variation in wall thickness and local adhesion of scales. As a result of bending of the long steel pipe, the casing 21 and the cover 41 would sometimes be spread outward. Since the engaging surfaces of the flange 22a of the outer case 22 and the jaw of the clamp arm 53 are slanted as described above, a component of the spreading force is applied to the clamp arm 53 in the clamp arm releasing direction. If the steel pipe 11 is so extremely bent that the force applied to the clamp arm 53 due to the expansion of the casing and cover caused by the bending pipe exceeds the clamping force, that is, the pressure of fluid supplied to the clamping hydraulic cylinder 54, then the clamp arm 53 is slightly turned in the release direction. As a result, the plunger 54*a* of the clamping hydraulic cylinder 54 is moved back and the cover 41 is slightly spaced apart from the casing 21. Since the elastic sealing member 51 in the channel 50 expands itself so as to project beyond the outer cover flange surface under uncompressed conditions, an effective seal is still maintained between the cover 41 and the casing 21 which are spaced apart a short distance from each other, thereby preventing leakage of cooling water from within the cylindrical assembly 12. Although retraction of the plunger 54*a* causes the pressure in the clamping hydraulic cylinder 54 to increase, no alarm signal is developed by the pressure switch 61 because such an increased pressure in the clamping hydraulic cylinder 54 is lower than the preset level in the pressure switch 61. In the case of temporary behavior of a steel pipe during quenching which is not regarded as being abnormal, for example, bending of a steel pipe within the above-mentioned range occurring with the local development of martensite transformation, normal cooling is continued. Neither the pressure switch 61 generates any alarm signal nor cooling water leaks out of the cylindrical assembly 12. If the steel pipe 11 is further bent to move the cover 41 away from the casing 21 such that the elastic sealing member 51 is spaced apart from the abuting surface of the casing flange, then the clamp arm 53 is further turned to further move back the plunger 54*a* to increase the pressure in the clamping hydraulic cylinder 54. When the pressure in the clamping hydraulic cylinder 54 is increased above the preset level in the pressure switch 61, the pressure switch 61 generates an alarm signal with which the selector valve 58 is actuated to change its flow path connection such that the clamping hydraulic cylinder 54 retracts its plunger 54*a*, thereby releasing the clamp arm 53. The clamp arm 53 is automatically released in this manner to protect the clamping mechanism when the steel pipe 11 under cooling is extremely bent to apply an excessive load to the clamp arm 54. Since the steel pipe 11 cannot be normally cooled after the release of the clamp arm, the apparatus may preferably be designed such that injection of cooling water into the cylindrical assembly through the nozzles is interrupted in response to the above-mentioned alarm signal.

A steel pipe hardening test was carried out using the steel pipe hardening apparatus of the above-mentioned construction.

Steel pipes used in the test had an outer diameter of 177.8 mm, a wall thickness of 30 mm (and accordingly, an inner diameter of 117.8 mm), and a length of 12,000 mm. They are formed of AISI 4130 steel, the results of check analysis being 0.29% C, 0.23% Si, 0.51% Mn, 0.98% Cr, and 0.20% Mo. The outer and inner nozzles had inner diameters of 476 mm and 117.8 mm, respectively.

Immediately after a test steel pipe was uniformly heated at a temperature of 920° C., it was conveyed into the cylindrical assembly. The outer nozzle injected cooling water at a flow rate of 6,600 $m^3$/hour and at an average flow velocity of 12.0 m/sec while the inner nozzle injected cooling water at a flow rate of 100 $m^3$/hour and at an average flow velocity of 2.5 m/sec. The steel pipe was quenched for 25 seconds under these conditions and thereafter maintained in the cooling water in the tank for a further 15 seconds, and then lifted out of the tank by means of the chain dogs.

The thus hardened steel pipes were determined for hardness, obtaining the results shown in Table 1.

TABLE 1

| | Hardness ($H_{RC}$) | | |
|---|---|---|---|
| | Longitudinal direction | | |
| Thickness direction | Front end* | Intermediate | Back end* |
| Outside surface | 50.5 | 49.8 | 51.8 |
| Mid wall | 50.1 | 50.4 | 50.7 |
| Inside surface | 51.6 | 50.0 | 50.6 |

*300 mm inside from the extreme end

The continuous cooling transformation diagram of the test steel indicates that the steel has a hardness $H_{RC}$ of 43.3 at 90% martensite ratio. The data of Table 1 show that the hardness of the hardened test steel pipes is at a fully acceptable level. In addition, in spite of the length and thickness, the hardened steel pipes are substantially uniform in hardness both in the longitudinal and radial directions. With the steel pipe hardening apparatus of the present invention, steel pipes are uniformly and rapidly cooled over their entire length and thickness, resulting in improved hardening effect.

Figure 17:
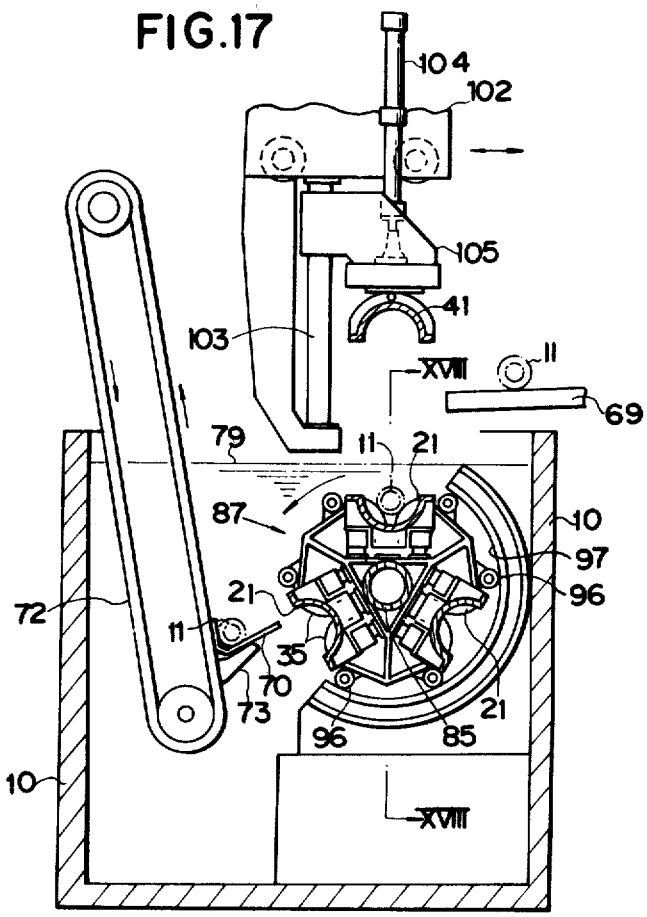
FIG. 17 is a transverse cross-sectional view showing another embodiment of the present steel pipe hardening apparatus.
Figure 18:
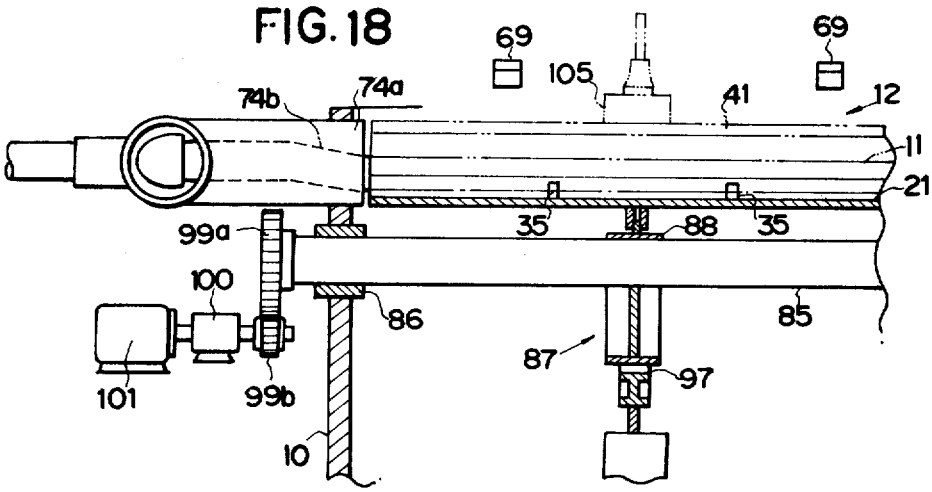
FIG. 18 is a longitudinal cross-sectional view of the apparatus taken along line XVIII—XVIII in FIG. 17.
Figure 19:
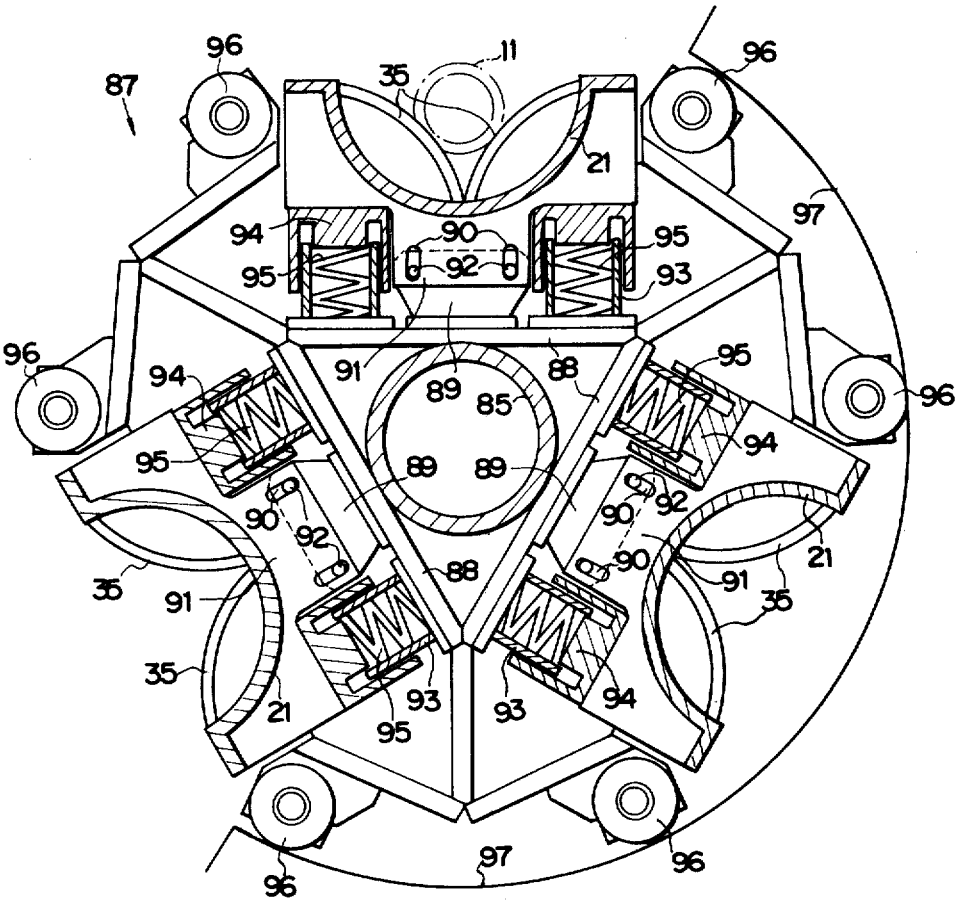
FIG. 19 is an enlarged view of the rotor in the apparatus of FIG. 17.

Another embodiment of the steel hardening apparatus according to the present invention is illustrated in FIGS. 17 to 19. A shaft 85 extending horizontally and longitudinally of the cooling tank 10 is rotatably journalled by means of bearings 86 attached to the front and rear end walls of the cooling tank 10. The shaft 85 is provided with a plurality of rotors 87 at given intervals. One rotor 87 is illustrated in the enlarged view of FIG. 19. The rotor 87 has three mounting seats 88 circumferentially arranged at equal intervals. To each of the mounting seats 88 is mounted a substantially semi-cylindrical casing 21 which extends parallel to the shaft 85 and forms the lower half of a cylindrical assembly 12 for receiving a steel pipe. More specifically, to the mount seat 88 is attached a radially extending block 89. A pair of longitudinally extending pins 92 are embedded to each side of the block 89. On the other hand, the casing 21 has a pair of radially extending flanges 91 for each block 89. A pair of slots 90 are formed in each flange 91. The mounting base 89 is interposed between a pair of the flanges 91 with the pins 92 being loosely fit in the slots 90. The casing 21 is thus mounted on the mounting seats 88 for limited motion in the radial direction with respect to the shaft 85 while the longitudinal motion of the casing 21 is inhibited. Furthermore, each of the mounting seats 88 has a pair of hollow sleeves 93 extending outwardly of the rotor 87 and having an open upper end. The casing 21 at the rear surface has a pair of studs 94 which are received in the sleeves 93 on the mounting seat 88. A resilient member 95 in the form of a Belleville spring is placed in the sleeve 93 between the seat 88 and the stud 94. With this arrangement, when the steel pipe is dropped into the casing 21, the resilient members 95 function as dampers to absorb the shock to the casing 21 by the steel pipe 11. The rotor 87 also has a plurality of rollers 96 circumferentially disposed at equal intervals. A guide rail 97 is attached to the tank 10 so as to surround the rotor 87. The relationship between the rotor 87 and the guide rail 97 is such that the rollers 96 on the rotor 87 are in rolling contact with the guide rail 97. As seen from FIG. 17, the guide rail 97 is of a semi-circular shape having its center located on the central axis of the rotor 87. The rail 97 is an arc of 180° and extends from a position off to the lower left of the rotor 87 to a position off to the upper right of the rotor 87 when viewed in FIG. 17. Accordingly, the rotor 87 is rotated along the guide rail 97 which serves as a bearing while the arc of the guide rail 97 is not obstructive to transfer of a steel pipe into and out of the casing.

Disposed at given intervals in the casing 21 are supports 35 for holding the steel pipe 11 substantially horizontal in the casing 21.

To the end portion of the shaft 85 which extends out of the cooling tank 10 is secured a gear 99*a* which meshes with a gear 99*b* on the output shaft of a reduction gear unit 100, which in turn, is connected to an electric or hydraulic motor 101. The motor 101 is intermittently energized to rotate the shaft 85 in one direction shown by an arrow via the gear train such that the casings 21 circumferentially mounted on the rotor 87 are sequentially positioned right above the shaft 85.

Above the cooling tank 10, a carriage 102 is mounted on a frame (not shown) for free motion in the transverse direction, that is, the direction shown by an arrow in FIG. 17. A guide rod 103 is suspended from the carriage 102 and a movable block 105 is mounted for sliding motion on the guide rod 103. The block 105 is also connected to a plunger of a hydraulic cylinder 104 fixedly secured to the carriage 102. To the lower surface of the movable block 105 is attached a substantially semi-cylindrical cover 41 with the concave facing downward. The cover 41 forms with one of the casings 21 a cylindrical assembly 12 for receiving a steel pipe therein. The cylindrical assembly 12 is completed by actuating the hydraulic cylinder 104 to move the cover 41 downward so as to mate with one of the casings 21 which has been positioned right above the shaft 85.

At the front end wall of the cooling tank 10 is provided an outer nozzle 74*a* for providing the interior of the cylindrical assembly 12 with a longitudinally flowing cooling water stream. Within the outer nozzle 74*a* is inserted an inner nozzle 74*b* for providing the inside of the steel pipe 11 in the cylindrical assembly 12 with a longitudinally flowing cooling water stream.

Above one side of the wall of the cooling tank 10 are arranged a plurality of loading skids 69 which are slanted downward toward the cooling tank 10 for allowing the steel pipe to roll thereon and fall to the upward facing casing 21. A plurality of discharging skids 70 are arranged on the bottom of the cooling tank 10 at the side opposite to the loading skids 69 with respect to the shaft 85. The discharging skids 70 receive the steel pipe 11 which is thrown out of the casing 21 when the casing is rotated with the shaft 87. A chain 72 for conveying the steel pipe 11 out of the cooling tank 10 is extended between a position below the discharging skids 70 and a position above the cooling tank 10. The chain 72 is provided with a plurality of chain dogs 73 at given intervals for picking up the steel pipe 11 from the lower end of the skids 70 to above the cooling tank 10.

Using the steel hardening apparatus of the above construction, a steel pipe may be quenched in the following manner. First, the motor 101 is energized to rotate the shaft 85 with the rotor 87 to position one of the casings 21 right above the shaft 85 so as to face upward. A hot steel pipe 11 rolls along the loading skids 69 and falls into the upward facing casing 21. The hot steel pipe 11 is thus placed substantially horizontal on the supports 35 in the casing 21. When the steel pipe 11 falls onto the supports 35, the resilient members 95 located between the casing 21 and the mounting seats 88 are compressed to allow the casing 21 to move downward, thereby damping the shock by collision of the steel pipe 11 against the supports. Thereafter, the hydraulic cylinder 104 is actuated to move downward the block 105 with the cover 41, thereby placing the cover 41 on the casing 21 in a mating relationship. After the steel pipe 11 is received in the casing 21 and the cylindrical assembly is completed by integrating the casing 21 and the cover 41, cooling water is injected through the outer and inner nozzles 74*a* and 74*b* to provide longitudinally flowing cooling water streams outside and inside the steel pipe 11 to quench the steel pipe 11. If the cooling tank 10 is filled with cooling water to a level above the rotor, the steel pipe 11 is previously cooled with this cooling water in the cooling tank 10 when it falls onto the casing 21. This previous cooling is effected only at a low rate of cooling for a short time. Substantial hardening of the steel pipe 11 is initiated by injecting cooling water through the outer and inner nozzles 74*a* and 74*b*.

After the steel pipe 11 received in the cylindrical assembly 12 is cooled for a given time, for example, several ten seconds, the cover 41 is lifted to open the cylindrical assembly 12 and the rotor 87 is rotated an angle of 120° counterclockwise when viewed in FIG. 17. As the casing 21 having the hardened steel pipe 11 received is tilted with the rotation of the rotor 87, the hardened steel pipe 11 falls from the casing 21 onto the discharging skids 70. When the rotor 87 has been rotated an angle of 120°, the subsequent one of the casings 21 is positioned right above the shaft 85 so that it may receive a following steel pipe to be hardened. In practice, a quenched or hardened steel pipe is dropped from one casing 21 immediately before a following hot steel pipe is dropped into the subsequent casing 21. The steel pipe hardening apparatus of the present invention can continuously and rapidly quench a number of steel pipes in this manner.

When it is desired to change the inner diameter of the cylindrical assembly 12 so as to match with the outer diameter of a steel pipe to be hardened, a set of the casing 21 and the cover 41 may be exchanged or a suitable adapter having a semi-circular cross-section may be attached to the casing 21 and the cover 41. More preferably, the rotor is provided with four mounting seats circumferentially arranged at equal intervals instead of the three mounting seats 88 in the above embodiment. Among these four, a pair of diametrically opposed mounting seats are provided with casings for large- or intermediate-diameter steel pipes while another pair of mounting seats are provided with casings for small-diameter steel pipes. Then, the need for exchanging the casing and cover each time when the diameter of steel pipes to be hardened is changed is eliminated. The rate of operation is increased because it is unnecessary to interrupt the steel pipe hardening apparatus for the exchange of the casing and cover.

Although the injection means including outer and inner nozzles 74*a* and 74*b* is illustrated in the above embodiments, the present invention is not limited to the use of such injection means. In the case of thin-walled steel pipes, the double nozzle structure is not necessarily required. An injection means comprising a single nozzle having an open end substantially equal in inner diameter to the cylindrical assembly 12 may be used to inject cooling water into the cylindrical assembly to provide the outside and inside of the steel pipe with longitudinally flowing cooling water streams because a thin wall will not induce a substantial turbulent flow. Furthermore, the cylindrical assembly 12 may be placed either below or above the level of cooling water in the cooling tank 10. Preferably, the cylindrical assembly 12 is submerged in cooling water because the cooling water functions as a damping medium when a steel pipe falls onto the casing 21. Since the falling speed of the steel pipe is reduced by the cooling water, the impact to the cylindrical assembly 12 by the steel pipe 11 is reduced, minimizing damage to the surface of the steel pipe. In addition, cooling water promptly enters the inside of the steel pipe, thereby preventing occurrence of defects such as soft spots.

As understood from the foregoing, since the steel pipe hardening apparatus according to the present invention allows cooling water to be injected through injection means located at one end of a cylindrical assembly into a hot steel pipe received in the cylindrical assembly in the longitudinal direction thereof, the steel pipe is quenched with cooling water streams longitudinally flowing outside and inside the steel pipe. The cooling water which has taken up heat from the steel pipe instantaneously and rapidly flushes past the steel pipe and fresh cooling water comes in contact with the steel pipe to provide a constant rate of cooling. Since the steel pipe to be hardened is held by supports so as to align the steel pipe with the cylindrical assembly, annular and circular flow paths having substantially the same cross-sectional areas are longitudinally defined outside and inside the steel pipe. The distribution of flow velocity of cooling water streams in proximity to the outer and inner surfaces of the steel pipe becomes substantially uniform at any cross sections over the entire length. As a result, the rate of cooling is stabilized and the steel pipe is uniformly hardened over its entire length. The steel pipe hardening apparatus according to the present invention is free of the disadvantages encountered in the conventional ring-type and immersion hardening apparatus, including soft spots and cracks as well as deformation like bending. Since the steel pipes are quenched with parallel streams of cooling water flowing longitudinally of the steel pipe, the supports for supporting the steel pipe may be of a substantial width without impairing the hardening effect, and hence, the impact stress caused by the steel pipe dropping onto the support means is reduced to minimize damage to the surface of the steel pipe. Since provision of a double nozzle structure consisting of outer and inner nozzles for injecting cooling water into and around the steel pipe allows the flow rates of cooling water flowing outside and inside the steel pipe or rates of cooling at the outer and inner surfaces of the steel pipe to be independently controlled, the rate of cooling may be properly controlled and particularly, occurrence of cracks is prevented, which leads to a further improvement in the quality of hardened steel pipes.

In the steel pipe hardening apparatus according to the present invention, the cylindrical assembly is formed by an outer case and outer cover, and an inner case and an inner cover are detachably mounted inside the outer case and cover to form a cylindrical container for receiving a steel pipe to be hardened. If plural sets of inner cases and covers having different radii of curvature or dimensions at the inner surface are prepared and among them a proper set of an inner case and cover dimensioned so as to meet the outer diameter of a particular steel pipe may be selected and mounted inside the outer case and cover, then a flow path having a proper cross-sectional area may be defined between the container and the pipe, and hence, the flow rate of cooling water flowing outside the steel pipe may be optimized. Since it is precluded to pump an excessively large amount of cooling water, the power required to pump cooling water or the operating cost may be reduced, achieving energy saving.

Further, in the steel pipe hardening apparatus according to the present invention, abnormal bending of a steel pipe in the cylindrical assembly during cooling or the resultant excessive load applied to a clamp arm is detectable as an increase of pressure of fluid in a hydraulic cylinder for actuating the clamp arm. The clamp arm is released to disengage the casing from the cover on the basis of the detected value. It is possible to prevent failure of the clamping mechanism including the clamp arms, pivots and hydraulic cylinders. Since the clamping mechanism is not required to be of large dimensions to withstand an excessively large load, the entire apparatus may be reduced in dimension and weight.

Finally, in the second embodiment of the steel pipe hardening apparatus according to the present invention, a plurality of casings each forming the lower half of a cylindrical assembly for receiving a steel pipe to be hardened therein are circumferentially mounted at equal intervals on a rotor rotatable about a horizontal axis and a cover which forms the cylindrical assembly with one of the casings when mated therewith is disposed for vertical motion above the rotor. After the cover is lifted away from one of the casings which has been at an upward facing position, the rotor is rotated a given angle. As the casing having a hardened steel pipe received is tilted with the rotation of the rotor, the steel pipe will fall from the casing. At the same time, the subsequent one of the casings is shifted to the upward facing position. The step of dropping a hardened steel pipe from one casing may be conducted substantially at the same time as the step of introducing a following hot steel pipe into the subsequent casing. This minimizes the so-called idle time, contributing to an improvement in the rate of operation or production of the apparatus. If a variety of casings dimensioned so as to match with large-, intermediate- and small-diameter steel pipes are mounted on the rotor, the apparatus is adaptable to steel pipes having different diameters without exchanging one casing for another casing. This minimizes the interrupting time, also contributing to an improvement in the rate of operation of the apparatus.

What is claimed is:

1. An apparatus for hardening a steel pipe by quenching it with a liquid coolant, comprising an elongated cylindrical assembly including a casing and a cover removably mated with the casing to define a cylindrical space therebetween for receiving the steel pipe, said cover being removed from said casing to allow insertion and removal of the steel pipe, support means disposed within said cylindrical assembly for supporting the steel pipe with its central axis being parallel to the central axis of said cylindrical assembly, and injection means disposed adjacent one end of said cylindrical assembly for injecting the coolant into and around the steel pipe in said cylindrical assembly in the longitudinal direction thereof.

2. A steel pipe hardening apparatus according to claim 1 which further comprises a cooling tank which is filled with a liquid coolant, said cylindrical assembly being placed substantially horizontal in said cooling tank.

3. A steel pipe hardening apparatus according to claim 1 wherein said injection means comprises an outer nozzle facing one end of said cylindrical assembly and having an inner diameter substantially equal to the inner diameter of said cylindrical assembly, and an inner nozzle disposed within said outer nozzle, facing one end of the steel pipe received in said cylindrical assembly, and having an inner diameter substantially equal to the inner diameter of the steel pipe.

4. A steel pipe hardening apparatus according to claim 3 wherein said inner nozzle is axially movable.

5. A steel pipe hardening apparatus according to claim 3 wherein said outer and inner nozzles are connected to conduits for supplying the liquid coolant, respectively, and each of the conduits has a flow control valve inserted.

6. A steel pipe hardening apparatus according to claim 2 wherein said casing has a semi-circular cross section opening vertically upward and said cover has a semi-circular cross section opening vertically downward.

7. A steel pipe hardening apparatus according to claim 2 wherein said casing is mounted on a rotatable shaft disposed parallel to said cylindrical assembly through a plurality of arms, whereby the shaft is rotated to turn said casing downward about the shaft such that the steel pipe drops from said casing.

8. A steel pipe hardening apparatus according to claim 7 wherein a plurality of skids for receiving the steel pipe dropping from said casing are arranged at the bottom of said cooling tank.

9. A steel pipe hardening apparatus according to claim 7 wherein said cover is mounted on another rotatable shaft disposed parallel to said cylindrical assembly through a plurality of arms, whereby the other shaft is rotated to turn said cover upward about the other shaft away from said casing such that said casing may be loaded with the steel pipe.

10. A steel pipe hardening apparatus according to claim 6 wherein means for clamping said casing to said cover is provided, said clamping means comprising a pair of flanges extending radially from the open edges and longitudinally of said casing, a pair of flanges extending radially from the open edges and longitudinally of said cover, and at least one pair of clamp arms pivotably mounted on the outer surface of said cover, each clamp having at one end a jaw adapted to engage with the flange of said casing at the lower surface to clamp said casing to said cover.

11. A steel pipe hardening apparatus according to claim 10 wherein said clamp arm at the center is pivotably mounted to a bracket affixed to the outer surface of said cover, and the other end of said clamp arm is pivotably connected to a plunger of a hydraulic cylinder mounted on the outer surface of said cover.

12. A steel pipe hardening apparatus according to claim 10 wherein the lower surface of each flange of said casing is slanted upward toward the flange edge, and the upper surface of the jaw of said clamp arm is correspondingly slanted.

13. A steel pipe hardening apparatus according to claim 11 wherein an oil hydraulic circuit for actuating said hydraulic cylinder is provided, the hydraulic circuit including a detector for detecting the pressure in said hydraulic cylinder and generating an alarm signal when the detected pressure exceeds a predetermined pressure, whereby said hydraulic cylinder performs retracting action in response to the alarm signal to release said clamp arm.

14. A steel pipe hardening apparatus according to claim 6 wherein said casing and cover have abutting surfaces at the open edges thereof, one of the mating abutting surfaces is provided with a longitudinally extending channel, and an elastomeric sealing member is received in said channel such that it partially projects out of the channel toward the other abutting surface.

15. A steel pipe hardening apparatus according to claim 2 wherein said casing consists of an elongated semi-cylindrical outer case and an elongated semi-cylindrical inner case detachably mounted within the outer case, said support means is disposed within the inner case, and said cover consists of an elongated semi-cylindrical outer cover and an elongated semi-cylindrical inner cover detachably mounted within the outer cover.

16. A steel pipe hardening apparatus according to claim 15 wherein said inner case is provided with at least one radially extending key, said outer case is provided with at least one retainer, and said inner case is longitudinally slided with respect to said outer case to bring the key into and out of engagement with the retainer.

17. A steel pipe hardening apparatus according to claim 16 wherein means for sliding said inner case with respect to said outer case is provided, said slide means comprising an end plate affixed to the other end of said inner case, a pin affixed to said end plate and extending perpendicular to the longitudinal direction of said inner case, a swing lever adapted to be in engagement with said pin, said swing lever being swingable longitudinally of said inner case, and a hydraulic cylinder having a plunger pivotably connected to said swing lever for moving said swing lever in a swing manner.

18. A steel pipe hardening apparatus according to claim 17 wherein said swing lever has a slot adapted to be in engagement with said pin, said slot having a width larger than the diameter of said pin.

19. A steel pipe hardening apparatus according to claim 15 wherein means for interlocking the outer and inner covers is provided, said interlocking means comprising a locking pin extending vertically upward from the top portion of said inner cover, said locking pin having a through-hole formed at the upper end, an opening formed in the top portion of said outer cover for allowing said locking pin to pass therethrough, and a cotter movably disposed on the top portion of said outer cover and adapted to be inserted into said through-hole in said locking pin.

20. A steel pipe hardening apparatus according to claim 2 which further comprises a rotatable shaft extending longitudinally of said cylindrical assembly, drive means for intermittenly rotating said shaft, at least one rotor fixedly mounted on said shaft and extending radially and circumferentially of said shaft, wherein a plurality of casings are mounted on said rotor so as to extend parallel to said shaft and open radially outward, and said cover is mounted for vertical motion above said shaft.

21. A steel pipe hardening apparatus according to claim 20 wherein damping means in the form of a resilient member is disposed between said casing and said rotor.

22. A steel pipe hardening apparatus according to claim 20 wherein said rotor is intermittently rotated in one direction so as to position one of said casings right above said shaft.

* * * * *